US011376848B2

(12) United States Patent
Kyu et al.

(10) Patent No.: US 11,376,848 B2
(45) Date of Patent: Jul. 5, 2022

(54) INKJET RECORDING DEVICE AND CONTROL METHOD FOR INKJET RECORDING DEVICE

(71) Applicant: Hitachi Industrial Equipment Systems Co., Ltd., Tokyo (JP)

(72) Inventors: An Kyu, Tokyo (JP); Takashi Kawano, Tokyo (JP); Tsuneaki Takagishi, Tokyo (JP); Manabu Kato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 17/265,643

(22) PCT Filed: Jun. 18, 2019

(86) PCT No.: PCT/JP2019/024032
§ 371 (c)(1),
(2) Date: Feb. 3, 2021

(87) PCT Pub. No.: WO2020/031510
PCT Pub. Date: Feb. 13, 2020

(65) Prior Publication Data

US 2021/0323304 A1 Oct. 21, 2021

(30) Foreign Application Priority Data

Aug. 7, 2018 (JP) ..... JP2018-148454

(51) Int. Cl.
*B41J 2/085* (2006.01)
*B41J 2/035* (2006.01)

(52) U.S. Cl.
CPC ..... *B41J 2/085* (2013.01); *B41J 2/035* (2013.01)

(58) Field of Classification Search
CPC ..... B41J 2/085; B41J 2/035
See application file for complete search history.

(56) References Cited

U.S. PATENT DOCUMENTS 4,544,930 A 10/1985 Paranjpe

FOREIGN PATENT DOCUMENTS

GB 2554924 A 4/2018
JP 6-305147 A 11/1994
(Continued)

OTHER PUBLICATIONS

International Search Report (PCT/ISA/210) issued in PCT Application No. PCT/JP2019/024032 dated Aug. 13, 2019 with English translation (four (4) pages).
(Continued)

*Primary Examiner* — Kristal Feggins
(74) *Attorney, Agent, or Firm* — Crowell & Moring LLP

(57) ABSTRACT

To realize high-quality printing with less printing distortion by reducing an influence of a Coulomb force that acts between ink particles which are ejected in an inkjet recording device.

The inkjet recording device is configured to charge ink particles ejected from a nozzle, deflect the charged ink particles, and print a character in a shape of an object to be printed. In the inkjet recording device, dots of each column of the character to be printed are divided into a plurality of blocks in a column direction. In addition, charging voltage data in which the order of the ink particles corresponding to the dots is switched in the divided block unit is stored, and a predetermined charging voltage is applied to the charging electrode on the basis of the charging voltage data.

6 Claims, 5 Drawing Sheets

(56) References Cited

FOREIGN PATENT DOCUMENTS

| | | | |
|---|---|---|---|
| JP | 7-329289 | A | 12/1995 |
| JP | 2002-1960 | A | 1/2002 |
| JP | 2003-118170 | A | 4/2003 |
| JP | 2006-289702 | A | 10/2006 |

OTHER PUBLICATIONS

Japanese-language Written Opinion (PCT/ISA/237) issued in PCT Application No. PCT/JP2019/024032 dated Aug. 13, 2019 (four (4) pages).

Extended European Search Report issued in European Application No. 19846824.1 dated Mar. 9, 2022 (eight (8) pages).

INKJET RECORDING DEVICE AND CONTROL METHOD FOR INKJET RECORDING DEVICE

TECHNICAL FIELD

The present invention relates to an inkjet recording device and a control method for the inkjet recording device.

BACKGROUND ART

There is known an inkjet recording device in which ink supplied by a pump is continuously ejected from a nozzle to eject ink particles, the ink particles are charged by a charging electrode, the charged ink particles are deflected by a deflection electrode, and the ink particles are landed on a medium to be recorded which moves in a direction orthogonal to a deflection direction to print characters, symbols, and the like.

With regard to the inkjet recording device of the related art, there is a printing control method by a so-called forward scanning in which the ink particles are made to sequentially fly from a lower dot position of dots in a column direction to an upper dot position when printing a dot matrix that is a set of dots constituting one character to print the character as the set.

However, the narrower an interval between the ink particles is, the further a Coulomb repulsive force generated between the ink particles increases. According to this, when employing a printing control method by the forward operation, since the interval between adjacent ink particles becomes narrow, an influence due to a Coulomb force increases. Particularly, in a case where both the ink particles have a high charging charge, a flying state due to the Coulomb repulsive force is influenced, a deviation (hereinafter, referred to as "printing distortion") occurs in a printing position, and the deviation results in a phenomenon in which a printing quality deteriorates.

With regard to the phenomenon, there is known control in which an (n−1) uncharged ink particle is inserted between the ink particles used in printing by subjecting signals creating atomization synchronization of the ink particles to one-frequency-division, two-frequency-division, three-frequency-division, . . . , and n-frequency-division by a counter or the like, and a distance between the charged ink particles is made to be n times, thereby realizing a high printing quality.

However, at this time, uncharged ink particles which are not used in printing are inserted, and thus there is a problem that a printing speed also becomes 1/n times. That is, an influence by the Coulomb repulsive force can be reduced by inserting the ink particles which are not used in printing between printing particles, and characters, symbols, and the like can be printed with high quality, but there is a disadvantage that the printing speed decreases due to insertion of the ink particles which are not used in printing.

In order to make a countermeasure for the problem, a control method described in JP 2002-001960 A (Patent Document 1) may be exemplified. In a technology of Patent Document 1, vertical dot data of dots which are vertically arranged along a direction in which the ink particles are deflected is obtained for every column, the number of dots used in printing among dots of the ink particles ejected from a nozzle body for every column and whether or not the dots used in printing are continuously charged are calculated on the basis of the vertical dot data, and in a case where continuous charged dots which are continuously charged exist, a dot that is not used in printing in the same column is interposed between the continuous charged dots to reduce printing distortion.

CITATION LIST

Patent Document

Patent Document 1: JP 2002-001960 A

SUMMARY OF THE INVENTION

Problems to be Solved by the Invention

In the technology described in Patent Document 1, a charging order of printing necessary dots and printing unnecessary dots is changed from a vertical column. However, the technology described in Patent Document 1 is established on the assumption that dots which are not used in printing exist in the vertical column of a dot matrix constituting a printing character. That is, in the case of printing a character in which dots which are not used in printing do not exist, the same problem as in the related art remains. Particularly, recently, a two-dimensional code in which the amount of information is very larger in comparison to typical characters has been recorded (printed) by the inkjet recording device. In the case of printing characters which are more complicated and have a large amount of information, the problem in the printing quality as described above becomes more serious. In addition, there is a disadvantage that the printing quality varies in accordance with the number of dots which are not used in printing.

Here, an object of the invention is to provide an inkjet recording device and a control method for the inkjet recording device which are capable of realizing printing with less printing distortion without depending on presence or absence of dots which are not used in printing.

Note that, in the following description, "characters" represent all types of information printed by the inkjet recording device. That is, the "characters" include not only typical characters (alphabets, Chinese characters, Hiragana, numbers, symbols, and the like) but also barcodes, two-dimensional codes, and the like.

Solutions to Problems

According to an aspect of the invention, there is provided an inkjet recording device including: a nozzle from which ink particles are ejected; a charging electrode that charges the ink particles ejected from the nozzle; a deflection electrode that deflects the ink particles charged by the charging electrode; and a control unit that controls the nozzle, the charging electrode, and the deflection electrode. The control unit divides a dot pattern of each column of a character to be printed into a plurality of blocks in a column direction, and applies a charging voltage to the charging electrode by sequentially switching the order of ejecting the ink particles in the divided blocks in a block unit.

According to another aspect of the invention, there is provided a control method for an inkjet recording device including a nozzle from which ink particles are ejected, a charging electrode that charges the ink particles ejected from the nozzle, and a deflection electrode that deflects the ink particles charged by the charging electrode. The control method includes: dividing a dot pattern of each column of a character to be printed into a plurality of blocks; generating a charging voltage by sequentially switching the order of ejecting the ink particles in the divided blocks in a block unit; and applying the generated charging charges to the charging electrode.

Effects of the Invention

According to the invention, since a dot pattern of each column of a character to be printed is divided into a plurality of blocks, and a charging charge is generated by sequentially switching the order of ejecting ink particles in a block unit, it is possible to enlarge a distance between the charged ink particles, and it is possible to realize printing with high printing quality.

MODE FOR CARRYING OUT THE INVENTION

Figure 1:
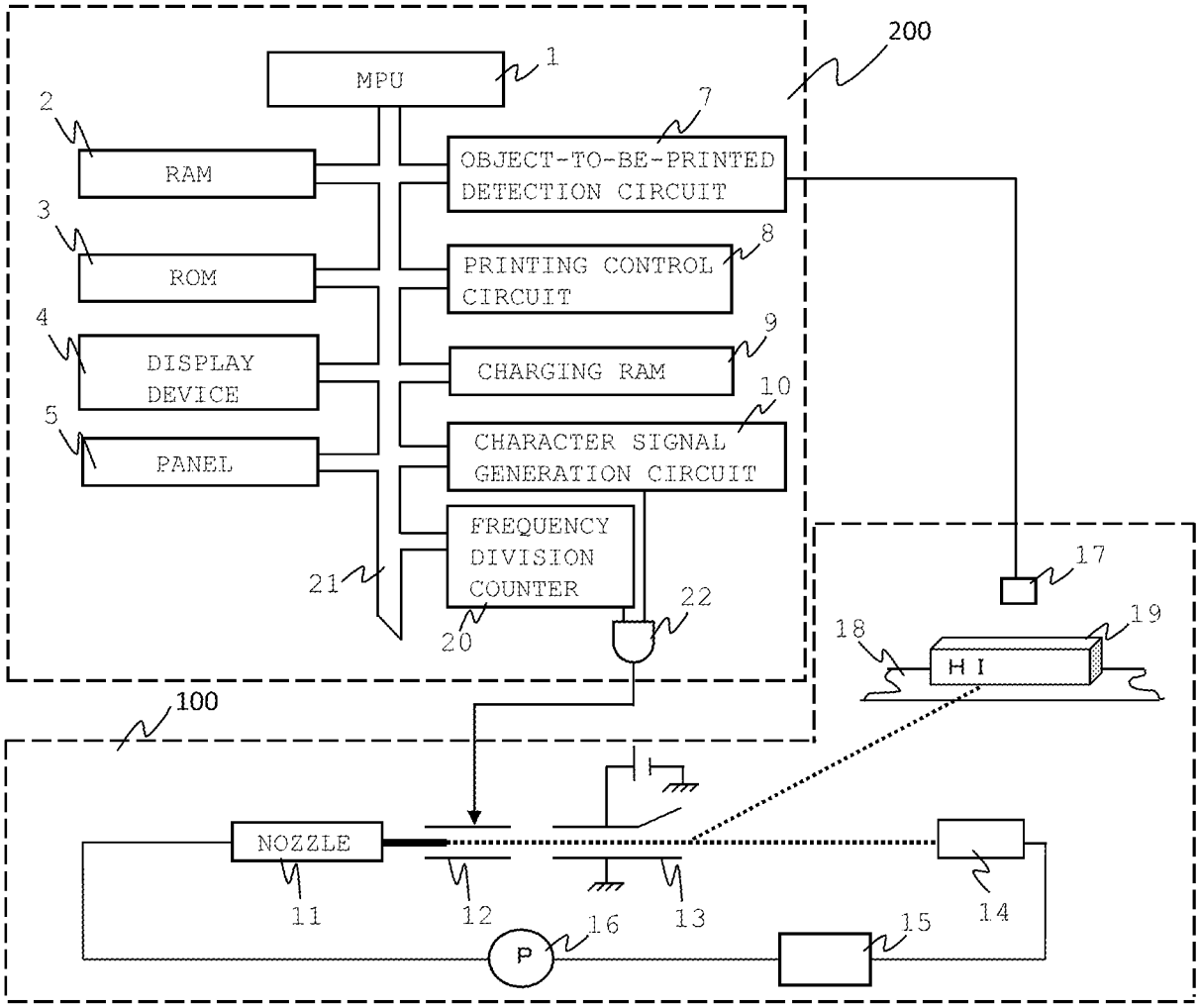
FIG. 1 is a view illustrating an overall configuration of an inkjet recording device according to an example of the invention.
Figure 2:
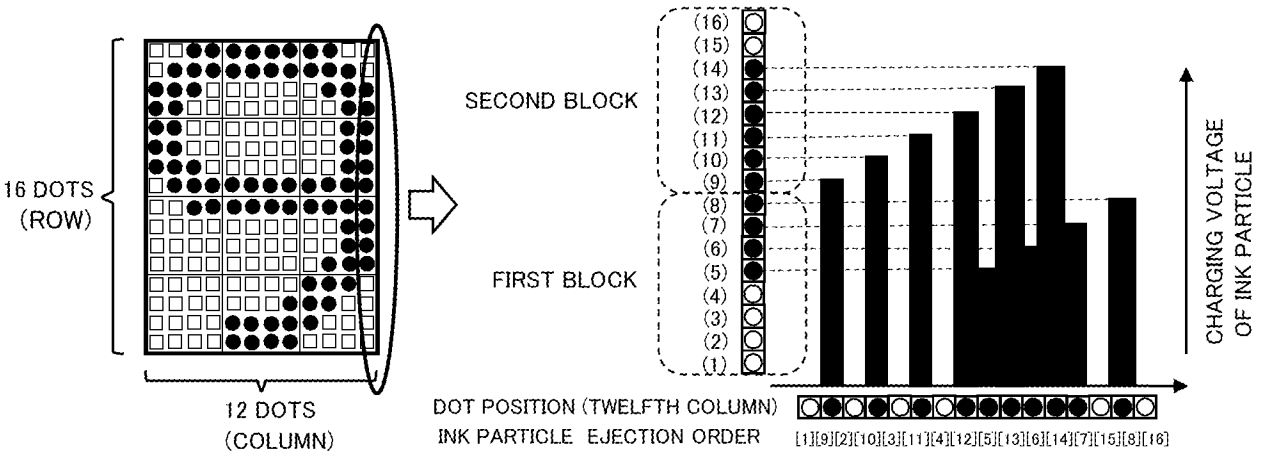
FIG. 2 is a view describing a printing order with respect to dot positions of a character.
Figure 3:
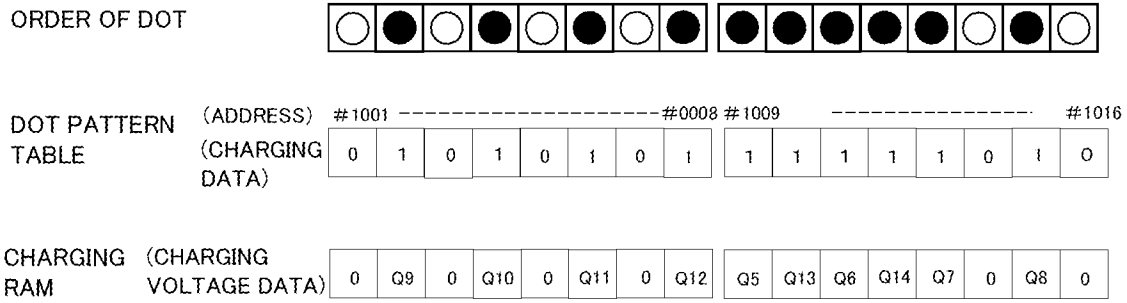
FIG. 3 is a view describing charging data and charging voltage data which correspond to the dot positions of the character.
Figure 4:
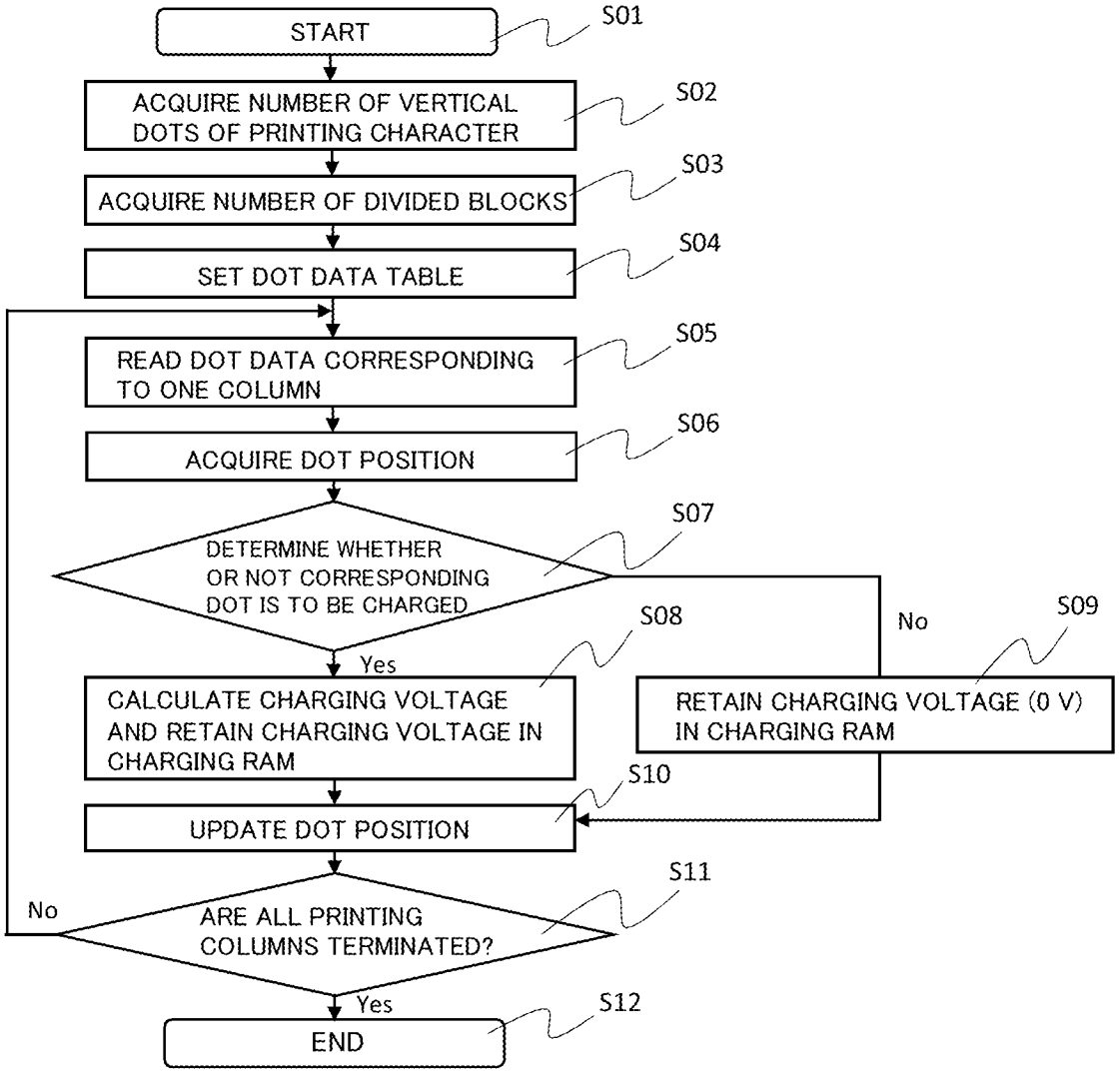
FIG. 4 is a process flowchart of a method of retaining a predetermined amount of charging in a charging RAM.

Hereinafter, an example of the invention will be described with reference to FIG. 1 to FIG. 4. Note that, the invention is not limited to the example. FIG. 1 is a view illustrating an overall configuration of an inkjet recording device according to this example. FIG. 2 is a view describing a printing order with respect to dot positions of a character in the example illustrated in FIG. 1. FIG. 3 is a view for describing charging data in a dot pattern table and charging voltage data in a charging RAM which correspond to the dot positions of the character in the example illustrated in FIG. 1. FIG. 4 is a flowchart illustrating operation processing content of a control unit in the example illustrated in FIG. 1.

(Configuration of Device)

First, an overall configuration of an inkjet recording device of an example of the invention will be described with reference to FIG. 1.

In FIG. 1, a reference numeral 100 represents a recording device main body, a reference numeral 200 represents a control unit that controls the recording device main body, and the units constitute the inkjet recording device.

The recording device main body 100 includes a nozzle 11 through which ink is ejected as ink particles, a charging electrode 12 that applies charges to the ejected ink particles, a deflection electrode 13 that deflects the charged ink particles, and a gutter 14 that recovers uncharged ink particles. In addition, the recording device main body 100 includes an ink tank 15 that stores ink that is used in printing, a pump 16 that supplies the ink stored in the ink tank 15 to the nozzle 11, a detection sensor 17 that detects arrival of an object to be printed 19 at a printing position, and a conveyor 18 that conveys the object to be printed 19. Note that, the ink recovered by the gutter 14 is returned to the ink tank 15 for reuse.

The control unit 200 includes a micro processing unit (MPU) 1, a random access memory (RAM) 2, a read only memory (ROM) 3, a display device 4, a panel 5, an object-to-be-printed detection circuit 7, a printing control circuit 8, a charging RAM 9, a character signal generation circuit 10, an AND gate 22, a frequency division counter 20, and a bus line 21. The MPU 1 has a function of controlling the entirety of the control unit 200. The RAM 2 temporarily store data in the control unit 200. The ROM 3 stores a program for operating the MPU 1, or the like in advance. The display device 4 displays a printing content and the like. The panel 5 is an input unit for inputting the printing content and the like, and is provided to operate or control the inkjet recording device by a device user in this example. The object-to-be-printed detection circuit 7 detects that an object to be printed arrives at a printing position through detection by the detection sensor 17. The printing control circuit 8 controls a printing operation of the inkjet storage device. The charging RAM 9 stores charging voltage data for charging each ink particle corresponding to each dot on the basis of charging data of the dot which is stored in a dot pattern table in the RAM 2. The character signal generation circuit 10 outputs the charging voltage data in the charging RAM 9 as a charging signal, and drives the charging electrode 12. The charging electrode 12 generates a predetermined charging voltage by the charging signal and charges ink particles. The bus line 21 is a signal line through which data or the like is transmitted between respective constituent devices inside the control unit 200.

Definition of Terminology

Here, prior to detailed description of the example, description will be given of terminologies such as "charging data", "charging voltage data", "charging signal", and "charging voltage" which are used in the following description.

First, the "charging data" is data representing charging or non-charging of each dot with respect to dots constituting a character to be printed. In this example, the data is stored as a dot pattern table in the RAM 2.

The "charging voltage data" is data of a charging voltage to be applied to each ink particle corresponding to each dot by using the charging data. In this example, the charging voltage data is obtained by the MPU 1, and is stored in the charging RAM 9.

The "charging signal" is a control signal for driving the charging electrode by the character signal generation circuit 10 after reading out the charging voltage data stored in the charging RAM 9. The "charging voltage" is a voltage that is actually applied to ink particles by the charging electrode on the basis of the charging signal so as to apply a predetermined amount of charging to the ink particles.

(Description of Device Operation)

First, an operator (device user) inputs printing information or the like from the panel 5 that is an input unit. The input information is temporarily stored in the RAM 2, and when the MPU 1 performs processing of a program stored in the ROM 3, a printing pattern is generated. Here, the control unit 200 controls the charging electrode 12 on the basis of the generated printing pattern. The charging voltage data for applying the charging voltage that is applied to charge the ink particles is stored in the charging RAM 9. In printing, the character signal generation circuit 10 reads out the content of the charging RAM, outputs the charging signal to the charging electrode 12, and drives and controls the charging electrode 12. According to this, ink particles passing through the inside the charging electrode 12 can be charged in a predetermined amount of charging. Next, the charged ink particles are deflected in the deflection electrode 13 in correspondence with the amount of charging. With regard to ink particles which are flying at the inside of the deflection electrode 13, since the amount of deflection is different depending on presence or absence of charging to the ink particles in the charging electrode 12 and the amount of charging, the ink particles fly to a predetermined position of the object to be printed 19 that is conveyed by the conveyor 18, and a character is printed.

When an operator inputs a setting value of a desired ink particle use rate from the panel 5, the MPU 1 creates charging data, which relates to charging of the ink particles, in a number corresponding to a total number of vertical dots to be printed by a program stored in the ROM 3. The charging data is stored in the RAM 2 as a dot pattern table. The dot pattern table is created in a number corresponding to characters to be printed. In addition, in the printing, a charging voltage corresponding to dots constituting each character is computed by using the charging data. The result is stored in the charging RAM 9.

In addition, the MPU 1 transmits the setting value of the ink particle use rate which is temporarily stored in the RAM 2 to the frequency division counter 20 through the bus line 21. The frequency division counter 20 creates a frequency division waveform in accordance with the setting value of the ink particle use rate. When the detection sensor 17 detects the object to be printed 19, a printing initiation command is transmitted to the MPU 1 through the object-to-be-printed detection circuit 7. The MPU 1 transmits data stored in the charging RAM 9 to the character signal generation circuit 10 through the bus line 21. The character signal generation circuit 10 changes the transmitted charging voltage data to a charging signal. The charging signal is relieved with a frequency division waveform output from the frequency division counter 20 in the AND gate 22, and is output to the charging electrode 12. Note that, the printing control circuit 8 controls timing at which the frequency-divided charging signal is transmitted to the charging electrode 12 through the bus line 21.

The charging electrode 12 charges ink particles ejected from the nozzle 11 by the charging signal of the character signal generation circuit 10. Ink particles which have passed through the charging electrode 12 are deflected by the deflection electrode 13. The deflected ink particles fly toward the object to be printed 19 and land on the object to be printed. According to this, a character is printed on the object to be printed 19. At this time, in ink particles for which the amount of charging is large, the amount of deflection is also large, and in this example, the ink particles are printed on an upward side in comparison to ink particles for which the amount of charging is small. Ink that is not used in printing, that is, ink particles which are not charged by the charging electrode 12 are recovered by the gutter 14, and are returned to the ink tank 15.

(Description of Printing Control Method)

Next, a specific control method for ink particles in the example illustrated in FIG. 1 will described with reference to FIG. 2 and FIG. 3.

First, prior to description of the content of FIG. 2 and FIG. 3, a way of viewing content described in the drawings will be described. In the following description, description will be given with reference to a case where a digit "9" is printed as an example. A dot configuration of the digit "9" is configured by sixteen dots (vertical direction)×12 dots (column direction) as can be clearly understood from description in FIG. 2.

In FIG. 2 and FIG. 3, a black circle (●) represents a dot (corresponding to an ink particle in printing) to which a charge is applied, and a while circle (○) represents a non-charging dot that is not used in printing and is not charged.

A graph in FIG. 2 describes sixteen dots in a vertical direction in a twelfth column (a column surrounded by an ellipse in the digit) constituting the digit "9" as an example.

Digits from (1) to (16) in the vertical axis in the graph illustrated on a right side of FIG. 2 represent numbers of the sixteen dots. In addition, the vertical axis of the graph on the right side of FIG. 2 represents a charging voltage of a step waveform, and a height of a painted vertical bar represents a charging voltage of a charged ink particle (●). An ink particle for which the charging voltage is high is configured to be printed at an upward position. That is, each ink particle indicated by ● flies in a state of being deflected in correspondence a charging signal level, and is printed on the object to be printed 19 to form a character. A non-charging particle (○) that is not used in printing is recovered in the gutter 14.

In addition, digits surrounded by parentheses [ ] ([1], [2], . . . , and [16]) are illustrated in the horizontal axis direction of the graph in FIG. 2, but the order of arrangement of the digits represents a flying order of ink particles ejected from the nozzle 11.

In addition, the vertical axis of the graph represents a value of the charging voltage of the step waveform, and the vertical black rod represents the charging voltage of the charged ink particle (●). An ink particle for which the charging voltage is high is configured to be printed at an upward position. That is, the order of digits with circles which are illustrated in the horizontal axis of the graph corresponds to the order of ejection of dots (16 dots in this example) corresponding to respective ink particles constituting the vertical direction of the twelfth column of a character (digit "9" in this example) to be printed.

In FIG. 2, respective dots (ink particles) indicated by ● fly in a state of being deflected in correspondence with the charging voltage applied to the charging electrode 12, and are printed on the object to be printed 19 to form a character. In addition, in uncharged dots (○) which are not used in printing, a charging voltage is zero, and thus the uncharged dots are recovered in the gutter 14 without change.

As illustrated in the graph of FIG. 2, in this example, dots of a printing character by screen setting are arranged in a state of being divided into two blocks including a first block and a second block. That is, first to eighth dots ((1) to (8)) are allocated to the first block, and ninth to sixteenth dots ((9) to (16)) are allocated to the second block.

In addition, with respect to the dots in the vertical direction which are divided into the blocks, the order of ejection of the ink particles is switched alternately in a block unit. That is, when a dot corresponding to an ink particle in the first block is selected first, the order of ejection of the subsequent ink particle is set to a dot in the second block. After ejection of the ink particle corresponding to the dot in the second block, a dot in the first block is set to be subsequently ejected. As can be clearly understood from FIG. 2, with regard to the ink particles (dots) in the vertical direction which constitute a character, first, the order of ejection of ink particles is set to (1) pertaining to the first block, and is subsequently set to (9) pertaining to the second block. In this manner, the order is sequentially (in this example, alternately) switched in a block unit. The order of dots in the case of being switched corresponds to "[1], [9], [2], [10], [3], [11], [4], [12], [5], [13], [6], [14], [7], [15], [8], and [16]" that is the order of the horizontal axis in the graph illustrated in FIG. 2. In addition, ink particles corresponding to the respective dots at that time are charged by the charging voltage indicated by the painted bar graph.

According to this, adjacent ink particles are not continuous, and thus the adjacent ink particles are not continuously ejected. Accordingly, a spatial distance between the adjacent ink particles can be enlarged and thus an influence by the Coulomb force can be reduced. As a result, a character with high printing quality can be recorded.

As described above, when applying the charging voltage to the charging electrode by alternately switching the order of ejection of the ink particles in two blocks provided with respect to the respective dots, a spatial distance between the respective dots can be enlarged, and an influence by the Coulomb force can be reduced. Particularly, in a case where a character to be printed has a large amount of information as in a two-dimensional code, high-accuracy (high-quality) printing is necessary, and thus this example is suitable for the case.

Next, description will be given of determination of the order of the respective dots constituting a character to be printed (the order of ejection of ink particles), and how to drive the charging electrode with reference to FIG. 3. In FIG. 3, the "order of dots" in the horizontal axis direction in the graph in FIG. 2 is illustrated in a first row. That is, in the sixteen dots constituting the twelfth column of the character "9" illustrated in FIG. 2, the order of dots is set to [1], [9], [2], [10], [3], [11], [4], [12], [5], [13], [6], [14], [7], [15], [8], and [16]. This represents the order of ejection of ink particles corresponding to respective dots. A "dot pattern table" stores charging data corresponding to the order of the dots. The dot pattern table is provided in the RAM 2 in FIG. 1 in this example. In "charging RAM" in FIG. 3, the content of the charging voltage data of the charging RAM 9 in the order of the dots. With respect to a character to be printed, the charging data is obtained from a charging or non-charging state of respective dots in the order of dots (refer to "order of dots" in FIG. 3) in each column unit. That is, since the charging voltage is determined in advance with respect to positions of respective dots in the vertical direction which constitute the character, when a charging voltage of a corresponding dot is applied on the basis of "charging data", "charging voltage data" in the charging RAM 9 can be obtained.

Specifically, when charging voltages for ink particles (1), (2), . . . , and (16) are set as V1 to V16, and charging voltage data corresponding to the charging voltages V1 to V16 are set as Q1 to Q16, in the case of the "order of dots" in FIG. 3, the charging voltage data is set to Q1, Q9, Q2, Q10, Q3, Q11, Q4, Q12, Q5, Q13, Q6, Q14, Q7, Q15, Q8, and Q16 in correspondence with "[1], [9], [2], [10], [3], [11], [4], [12], [5], [13], [6], [14], [7], [15], [8], and [16]". Here, since dots of [1], [2], [3], [4], [15], and [16] are non-charging dots (○), with respect to the dots, charging voltage is set to charging voltage data Q0 corresponding to a voltage V0 (for example, V0=0 bolt (V)) in the case of non-charging. As a result, as "charging voltage data", "Q0, Q9, Q0, Q10, Q0, Q11, Q0, Q12, Q5, Q13, Q6, Q14, Q7, Q10, and Q0" are obtained. In this manner, the "charging voltage data" illustrated in FIG. 3 can be obtained.

Note that, in FIG. 2 and FIG. 3, description has been given of the sixteen dots of the twelfth column constituting the character "9" to be printed, but the same processing is performed to dots of another column, and the same processing is performed with respect to entire dots constituting the character to be printed. In addition, the processing is performed for every character to be printed.

In the example in FIG. 1, the processing is performed when the MPU 1 executes a processing program stored in the ROM 3. In addition, the charging voltage data is stored in the charging RAM 9.

(Description of Method of Storing Predetermined Amount of Charging in Charging RAM)

Next, description will be given of a processing procedure of obtaining a charging voltage of each dot constituting a character to be printed by the charging RAM 9 with reference to FIG. 4. Note that, the processing is executed by the MPU 1 in FIG. 1 by using a processing program stored in the ROM 3.

In FIG. 4, first, processing starts in step S01. After the start, in step S02, the number of vertical dots of a printing character is acquired. In step S03, the number of divided blocks is acquired. The processing is performed when an operator performs setting by using the panel 5. Next, in step S04, the dot data table is set. This is set, for example, in the RAM 2. Next, in step 05, dot data information corresponding to one column of the printing character is read. Next, in step S06, a dot position is acquired. In step S07, with respect to dots corresponding to one column among dots, it is determined whether the dots are dots to be sequentially charged from a first dot or non-charging dots. In step S08, with respect to the dots to be charged, charging voltage data is retained in the charging RAM. In step S10, the dot position is updated by "+1". In step S09, with respect to (non-charging) dots which are not charged, the charging voltage data (0 V) in the case of the non-charging is retained in the charging RAM. In step S10, the dot position is updated by "+1". With respect to subsequent dots in the same vertical column, processing from steps S05 to S10 is performed.

When the processing from S05 to S10 is completed with respect to all dots in one vertical column, the processing proceeds to step S11. In step SS11, it is determined whether or not processing relating to all columns of the printing character is terminated. In step S11, it is determined that processing is terminated with respect to all columns (twelve columns in the example) constituting the character is completed, the processing proceeds to step S12 and is terminated.

Another Example

Note that, in the example, description has been given of an example in which the dots in the vertical directions which constitute a character are divided into two blocks. However, the invention is not limited thereto, and the number of blocks may be three or greater.

Figure 5:
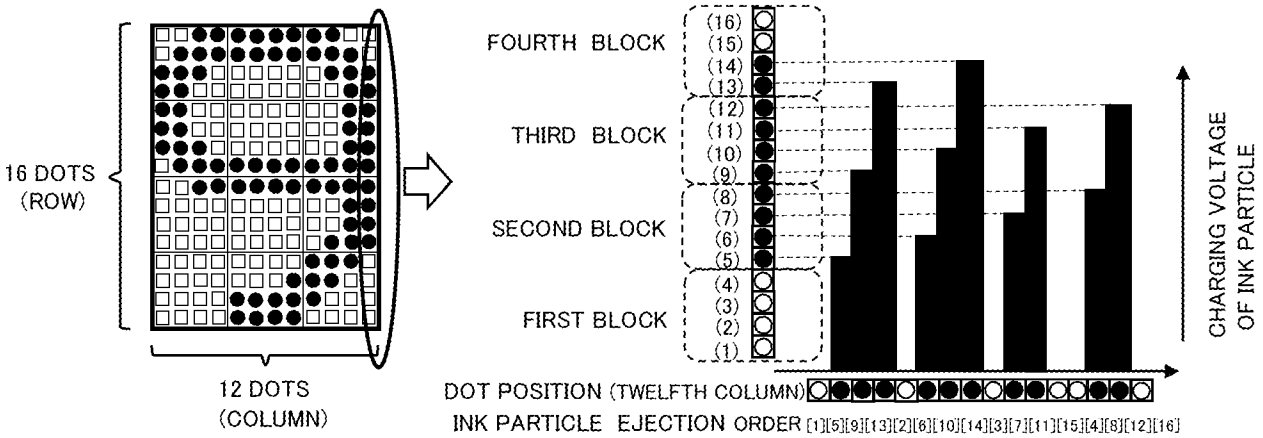
FIG. 5 is a view describing a printing order with respect to dot positions of a character in another example of the invention.

FIG. 5 is a view describing a printing order of a character according to another example of the invention. In the above-described example, the number of divided blocks is set to 2, but FIG. 5 illustrates a four-division example of a first block to a fourth block. Note that, an overall configuration of the inkjet recording device is the same as in the case illustrated in FIG. 1.

In the example of FIG. 5, with regard to the order of ejection of ink particles, ink particles (dots) in the vertical direction which constitute a character is switched in the order of (1) in the first block, (9) in the second block, (9) in the third block, and (13) in the fourth block. In addition, after the fourth block, it returns to the first block again, and the order of ejection of the ink particles is sequentially switched in a block unit. "[1], [5], [9], [13], [2], [6], [10], [14], [3], [7],

[11], [15], [4], [8], [12], and [16]" illustrated in the horizontal axis of a right graph in FIG. 5 corresponds to the order. In addition, as a charging voltage for charging each dot, a charging voltage indicated by a painted rod graph is supplied.

According to this, a spatial distance between adjacent ink particles can be greatly enlarged, and thus an influence of the Coulomb force can be reduced.

Note that, in the invention, the number of blocks can be further increased. The number of blocks also depends on the number of dots in one row constituting a character, but as in the above-described example, in a case where the number of dots in each column of the character is 16, it is preferable that the number of blocks is approximately 2 to 4.

REFERENCE SIGNS LIST

1 Micro processing unit (MPU)
2 Random access memory (RAM)
3 Read only memory (ROM)
4 Display device
5 Panel
7 Object-to-be-printed detection circuit
8 Printing control circuit
9 Charging RAM
10 Character signal generation circuit
11 Nozzle
12 Charging electrode
13 Deflection electrode
14 Gutter
15 Ink tank
16 Pump
17 Detection sensor
18 Conveyor
19 Object to be printed
20 Frequency division counter
21 Bus line
22 AND gate
100 Recording device main body
200 Control unit

The invention claimed is:

1. An inkjet recording device comprising:

a nozzle from which ink particles are ejected;

a charging electrode that charges the ink particles ejected from the nozzle;

a deflection electrode that deflects the ink particles charged by the charging electrode; and a control unit that controls the nozzle, the charging electrode, and the deflection electrode, wherein the control unit divides a dot pattern of each column of a character to be printed into a plurality of blocks in a column direction, wherein first to eighth dots of the plurality of blocks are allocated to a first block and ninth to sixteenth dots of the plurality of blocks are allocated to a second block, and applies a predetermined charging voltage to the charging electrode by sequentially switching the order of ejecting the ink particles in the divided blocks in a block unit.

2. The inkjet recording device according to claim 1, wherein the character is a two-dimensional code.

3. The inkjet recording device according to claim 1, wherein the control unit stores the charging voltage in correspondence with each dot position that constitutes the character, and supplies the stored charging voltage to the charging electrode in printing.

4. A control method for an inkjet recording device including a nozzle from which ink particles are ejected, a charging electrode that charges the ink particles ejected from the nozzle, and a deflection electrode that deflects the ink particles charged by the charging electrode, the control method comprising:

dividing a dot pattern of each column of a character to be printed into a plurality of blocks, wherein first to eighth dots of the plurality of blocks are allocated to a first block and ninth to sixteenth dots of the plurality of blocks are allocated to a second block;

generating a charging voltage by sequentially switching the order of ejecting the ink particles in the divided blocks in a block unit; and applying the generated charging voltage to the charging electrode.

5. The control method for an inkjet recording device according to claim 4, wherein the character is a two-dimensional code.

6. The control method for an inkjet recording device according to claim 4, wherein the charging voltage is stored in correspondence with each dot position that constitutes the character, and the stored charging voltage is applied to the charging electrode in printing of the character.

* * * * *